US009958233B2

(12) United States Patent
Considine

(10) Patent No.: US 9,958,233 B2
(45) Date of Patent: May 1, 2018

(54) DEEP CONCEALMENT HOLSTER ASSEMBLY

(71) Applicant: Jules Considine, Beaverton, OR (US)

(72) Inventor: Jules Considine, Beaverton, OR (US)

(73) Assignee: Jules Considine, Beaverton, OR (US)

( * ) Notice: Subject to any disclaimer, the term of this patent is extended or adjusted under 35 U.S.C. 154(b) by 42 days.

(21) Appl. No.: 14/866,178

(22) Filed: Sep. 25, 2015

(65) Prior Publication Data

US 2017/0089666 A1 Mar. 30, 2017

(51) Int. Cl.
*F41C 33/02* (2006.01)
*F41C 33/04* (2006.01)

(52) U.S. Cl.
CPC ..... *F41C 33/048* (2013.01)

(58) Field of Classification Search
CPC .... F41C 33/048; F41C 33/02; F41C 33/0209; F41C 33/0218; F41C 33/0227; F41C 33/06; F41C 33/0236
USPC ..... 224/192, 193, 238, 243, 911, 912
See application file for complete search history.

(56) References Cited

U.S. PATENT DOCUMENTS 4,971,236 A * 11/1990 Grummet ..... F41C 33/0209 224/193
7,258,259 B1 * 8/2007 Owens ..... A45F 5/02 224/192
7,314,152 B1 * 1/2008 Garrett ..... F41C 33/0236 224/192
2003/0075574 A1 * 4/2003 Mossman ..... F41C 33/0227 224/198
2011/0233244 A1 * 9/2011 Platts ..... F41C 33/046 224/243
2014/0097216 A1 * 4/2014 Rogers ..... F41C 33/046 224/243
2016/0061563 A1 * 3/2016 Bowman ..... F41C 33/0209 224/587
2016/0102940 A1 * 4/2016 Sykes ..... F41C 33/0236 224/587
2016/0209164 A1 * 7/2016 Fravala ..... F41C 33/046

* cited by examiner

*Primary Examiner* — Corey Skurdal
(74) *Attorney, Agent, or Firm* — Berkeley Law & Technology Group, LLP

(57) ABSTRACT

Example implementations relating to a deep concealment holster assembly are disclosed herein that may be utilized, in whole or in part, with unstructured clothing, such as without support of a separate waist belt, for example, without sacrificing holster's overall functionality and/or concealability.

20 Claims, 5 Drawing Sheets

DEEP CONCEALMENT HOLSTER ASSEMBLY

BACKGROUND

1. Field

The present disclosure relates generally to firearm accessories and, more particularly, to a deep concealment holster assembly.

2. Information

In the realm or domain of deep concealment holsters, such as holsters that may be worn underneath one or more layers of clothing and/or not inherently and/or necessarily exposed to the topmost layer, for example, improving tactical ability of a user to draw and/or re-holster a firearm with one hand without sacrificing or compromising wearing comfort may be as important as firearm concealability. These or like holsters, however, are typically made out of fabric, such as to provide more comfort against the wearer's skin, for example, but, at times, may snag on sights or other gun parts, quickly become frayed, come out of clothing (e.g., pants, etc.) during a draw-stroke, present issues with re-holstering due, at least in part, to collapsed holster entry point, or the like.

Deep concealment hybrid holsters, such as holsters typically made out of two different types of material, such as a more rigid shell (e.g., hard plastic, etc.) overlaying a more flexible and/or cushioned backing (e.g., padded fabric, leather, etc.) to create a holster pocket or body, for example, may also present challenges. For example, at times, these or like holsters may require an additional and/or separate supporting platform or feature, such as a sufficiently stiff leather or like trouser belt to anchor or attach the holster and/or provide a sufficient firearm retention via tension of the belt, among other things, which may be achieved predominantly while such a holster is worn. Another challenge may include a fabric or leather backing intruding into a trigger guard, such as during re-holstering, as one possible example, which may depress a trigger and create a risk of accidental or negligent discharge for certain firearms, such as firearms without a manual safety. A leather or fabric backing may also increase a holster's profile, for example, which, in turn, may negatively affect its overall concealability. Accordingly, how to implement a deep concealment holster that may be worn with unstructured or beltless clothing (e.g., yoga-type pants, elastic waist khakis, etc.), for example, while retaining or maximizing holster's tactical ability (e.g., one-handed withdrawal, re-holstering, etc.) without compromising concealability and/or everyday wearing comfort continues to be an area of development.

BRIEF DESCRIPTION OF THE DRAWINGS

Non-limiting and non-exhaustive aspects are described with reference to the following figures, wherein like reference numerals refer to like parts throughout the various figures unless otherwise specified.

SUMMARY

Figure 1:
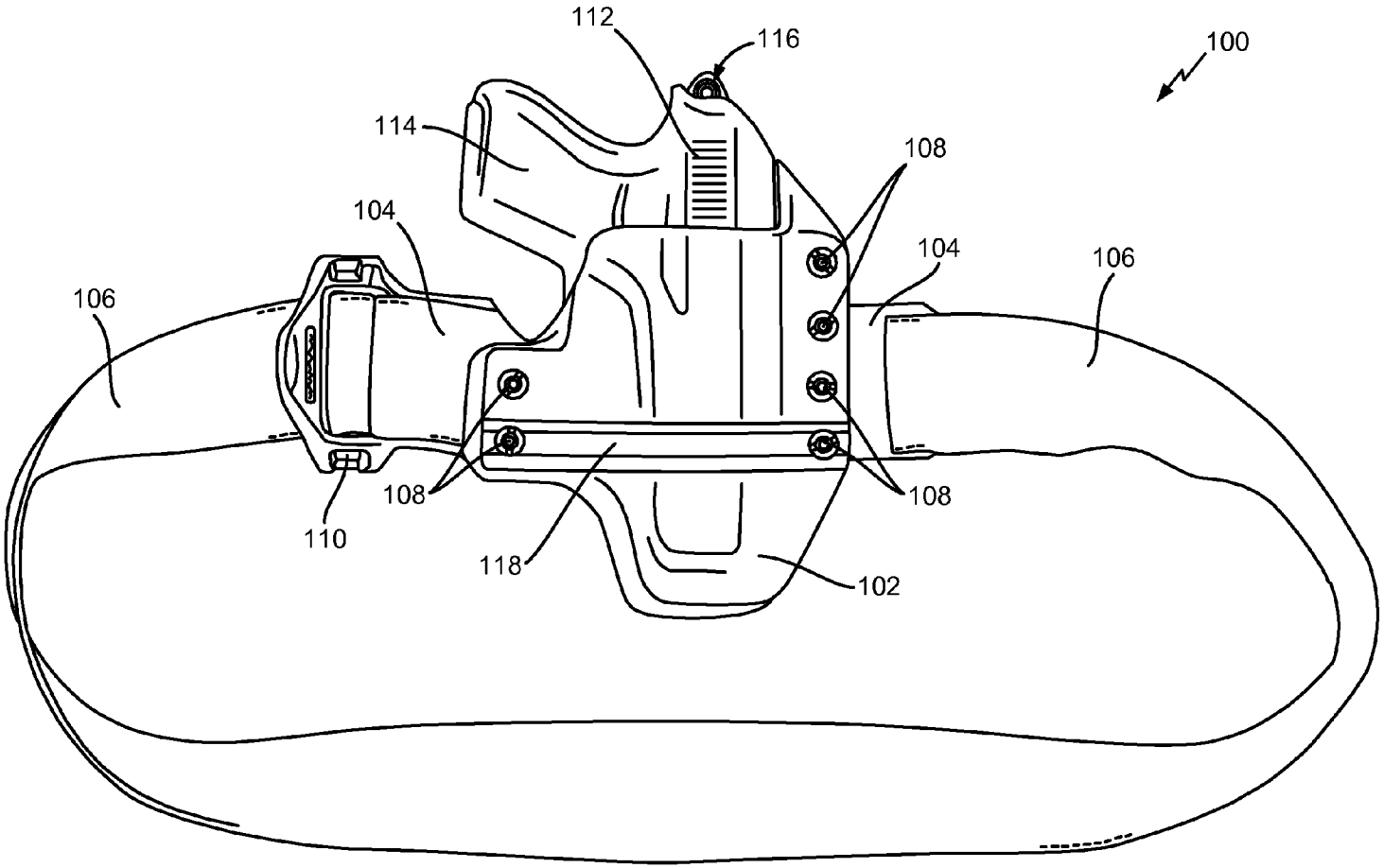
FIG. 1 is a schematic front view illustrating an implementation of a deep concealment holster assembly.

Example implementations relate to a deep concealment holster assembly. In one implementation, a deep concealment holster assembly may comprise a holster body comprising a front shell of substantially rigid material; a back shell of substantially rigid material attached to the front shell by first attachment means to define a compartment shaped for retainably securing an item; a substantially flexible pad comprising a generally flat panel attached by second attachment means to the holster body to face a wearer while the holster assembly is worn in the intended manner; and a belt assembly for detachably attaching the holster assembly to the wearer, the belt assembly comprising substantially flexible end segments secured to the holster body to allow the holster body to articulate in more than one dimension while the holster assembly is worn in the intended manner.

In another implementation, a deep concealment holster assembly may comprise the holster assembly for receiving and for withdrawing a handgun with one hand of a user, the holster assembly to be worn substantially at waist level of the user and to remain substantially static at the waist level during the withdrawing at least partially via engagement of a user's thumb against a thumb-pop element, the holster assembly being joined together via adjustable fastener means, the holster assembly further comprising a rigid holster comprising a united body with interior at least partially conforming to a shape of a particular handgun and capable of releasably retaining the handgun therein while substantially covering a handgun barrel, a handgun trigger, and a handgun trigger guard, the rigid holster further comprising the thumb-pop element positioned on the united body to be near the user's thumb while the user grips a grip of the handgun releasably retained in the rigid holster; a substantially flexible liner positioned at a back side of the holster that is against the waist level while the holster assembly is worn in the intended manner, the flexible liner being sufficiently large to cover an area of the back side of the holster to a substantial degree and having an edge that approximately matches an outline of the back side thereby allowing for comfortably carrying the handgun and for increased friction between the holster and a user's body; an adjustable waist-encircling belt for carrying the rigid holster and the substantially flexible liner, the belt having a pair of end portions of a substantially flexible material secured to at least the rigid holster, wherein the sections cooperate to conform to natural shapes of at least a portion of the rigid holster and at least a portion of the user's body thereby allowing the holster assembly to be worn with unstructured clothing while making the holster and the handgun releasably retained therein not readily visible.

In yet another implementation, a method of drawing a handgun from a deep concealment holster assembly may comprise gripping, with one hand, a grip of the handgun releasably secured in a holster body of the holster assembly; placing a thumb of the hand on a thumb-pop element positioned on the holster body to be near the thumb upon the gripping the grip of the handgun; pressing the thumb against the thumb-pop element while maintaining the gripping of the grip with the one hand; and withdrawing, while still maintaining the gripping of the grip with the one hand, a handgun from the holster body by pushing on the thumb-pop element with the thumb in a forward motion allowing the handgun to be pulled out from the holster body in a substantially linear sliding movement generally parallel to the orientation of a barrel of the handgun. It should be understood, however, that these are merely example implementations, and that claimed subject matter is not limited to these particular implementations.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, methods, assemblies, and/or components thereof that would be known by one of ordinary skill have not been described in detail so as not to obscure claimed subject matter.

Some example implementations relating to a deep concealment holster assembly are disclosed herein. In this context, the terms "deep concealment holster assembly," "holster assembly," "deep concealment holster," or simply "holster" may be used interchangeably and refer to a holster assembly that may be worn underneath one or more layers of clothing and/or not inherently and/or necessarily exposed to the topmost layer. As discussed below, in some instances, a deep concealment holster assembly may comprise, for example, a stand-alone unit capable of being worn with unstructured clothing, such as clothing that may be worn without support of a waist belt, for example, without sacrificing holster's overall functionality and/or concealability. As will also be seen, a deep concealment holster assembly discussed herein may provide other benefits and/or improvements over existing deep concealment holsters and/or assemblies. For example, a deep concealment holster assembly discussed herein may better conform to an applicable portion and/or shape of a wearer's body, at-rest and/or in-motion, may provide for more consistent retention of a firearm or other item regardless of presence and/or tension of a trouser belt, may allow for one-handed withdrawal and/or re-holstering, may address or alleviate skin irritability issues, and/or may provide for more consistent positioning and/or orientation of a firearm on a wearer's body, among other things.

Referring now to FIGS. 1-5, which are schematic illustrations of an implementation of a deep concealment holster assembly, referenced herein at 100. It should be noted that like numerals may designate like parts throughout to indicate corresponding and/or analogous components. It will also be appreciated that components illustrated have not necessarily been drawn to scale, such as for simplicity and/or clarity of illustration. For example, dimensions of some components may be exaggerated relative to other components. Further, it is to be understood that other embodiments may be utilized. Furthermore, structural and/or other changes may be made without departing from the scope and spirit of claimed subject matter. It should also be noted that directions and/or references, such as, for example, up, down, top, bottom, and so on, if applicable or appropriate, may be used to facilitate or support discussion and are not intended to restrict application of claimed subject matter. Therefore, the following detailed description is not to be taken to limit claimed subject matter and/or equivalents.

Thus, as illustrated in FIG. 1, according to an implementation, deep concealment holster assembly 100 may comprise, for example, a holster body 102 that may be attached or secured to substantially flexible end segments 104 of a belt assembly 106 via one or more attachment means 108. As also seen, belt assembly 106 may comprise, for example, a buckle or other fastening and/or tightening device 110, such as to attach loose ends of belt assembly 106 and/or secure (e.g., detachably attach, etc.) belt assembly 106 on a wearer's body. As discussed below, holster body 102 may, for example, be capable of retainably securing a suitable item, such as a handgun 112 having a grip 114. Claimed subject matter is not so limited, of course. For example, in some implementations, holster body 102 may be capable of retainably securing an ammunition magazine, flashlight, cell phone, appropriate tool(s), or other item(s), such as instead of or in addition to handgun 112. As also seen and as will be discussed in greater detail below, holster assembly 100 may include a thumb-pop element, illustrated generally via an arrow at 116. In some instances, holster assembly 100 may include a strap 118 that may, for example, be used, at least in part, to generate additional friction between and/or resistance to motion of holster body 102 against an inner face of a user's lower garment, such as while worn in the intended manner and/or while withdrawing handgun 112. At times, strap 118 may, for example, also be used, at least in part, for holster assembly reinforcement purposes. It should be noted that strap 118 may be optional in certain example implementations.

Figure 2:
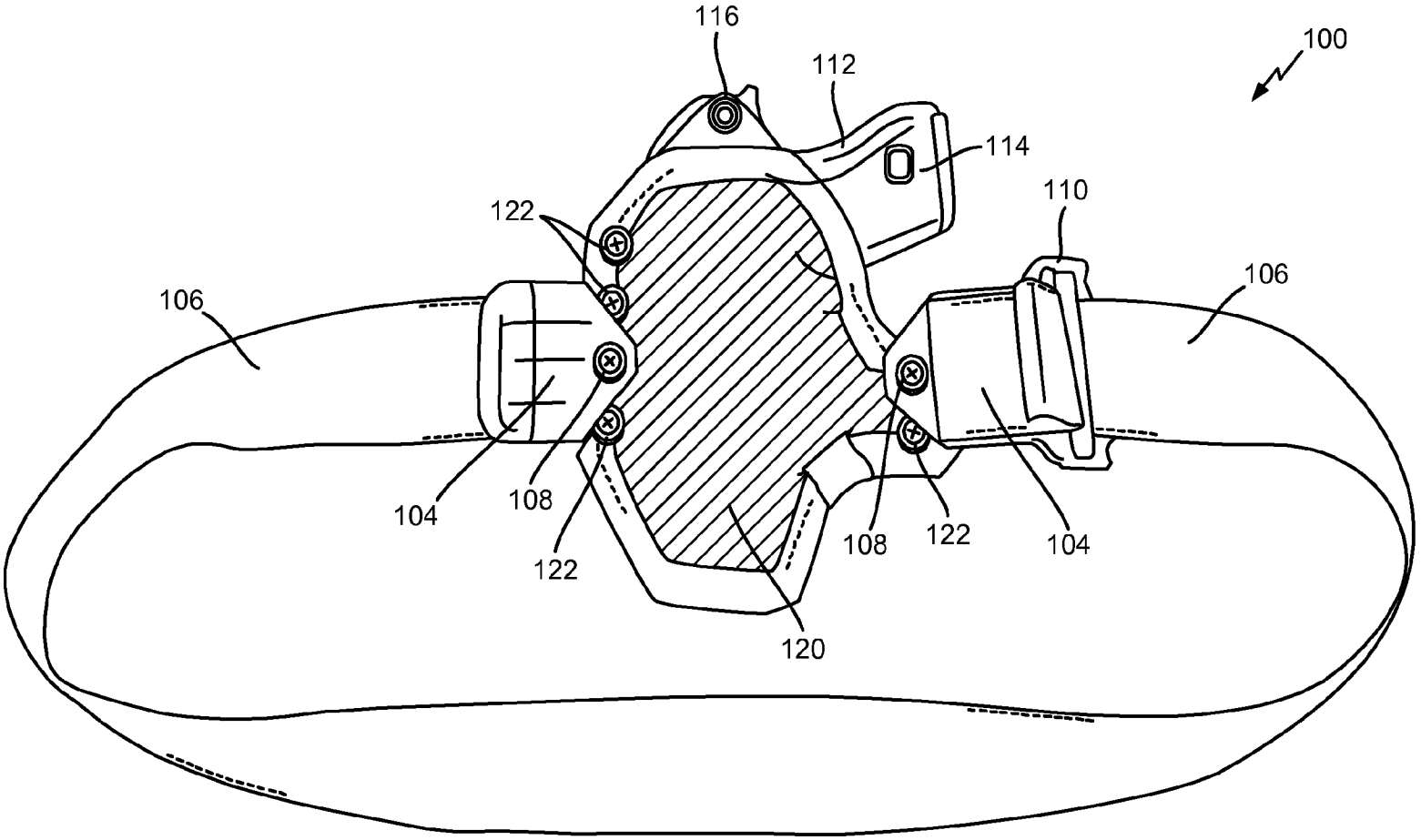
FIG. 2 is a schematic back view illustrating an implementation of a deep concealment holster assembly.

As further illustrated in FIG. 2, in an implementation, holster assembly 100 may comprise, for example, a suitable pad, such as a substantially flexible pad 120, for example, that may be attached via one or more attachment means 122 to holster body 102 to face a wearer, such as while holster assembly 100 is worn in the intended manner. An example of holster assembly 100 worn by a wearer, such as in the intended manner, for example, will be described in greater detail in connection with FIG. 5. It should be noted that one or more attachment means 122 may or may not be the same attachment means as attachment means 108, which may depend on a particular implementation, belt assembly, holster body, application or usage, or the like.

Figure 3:
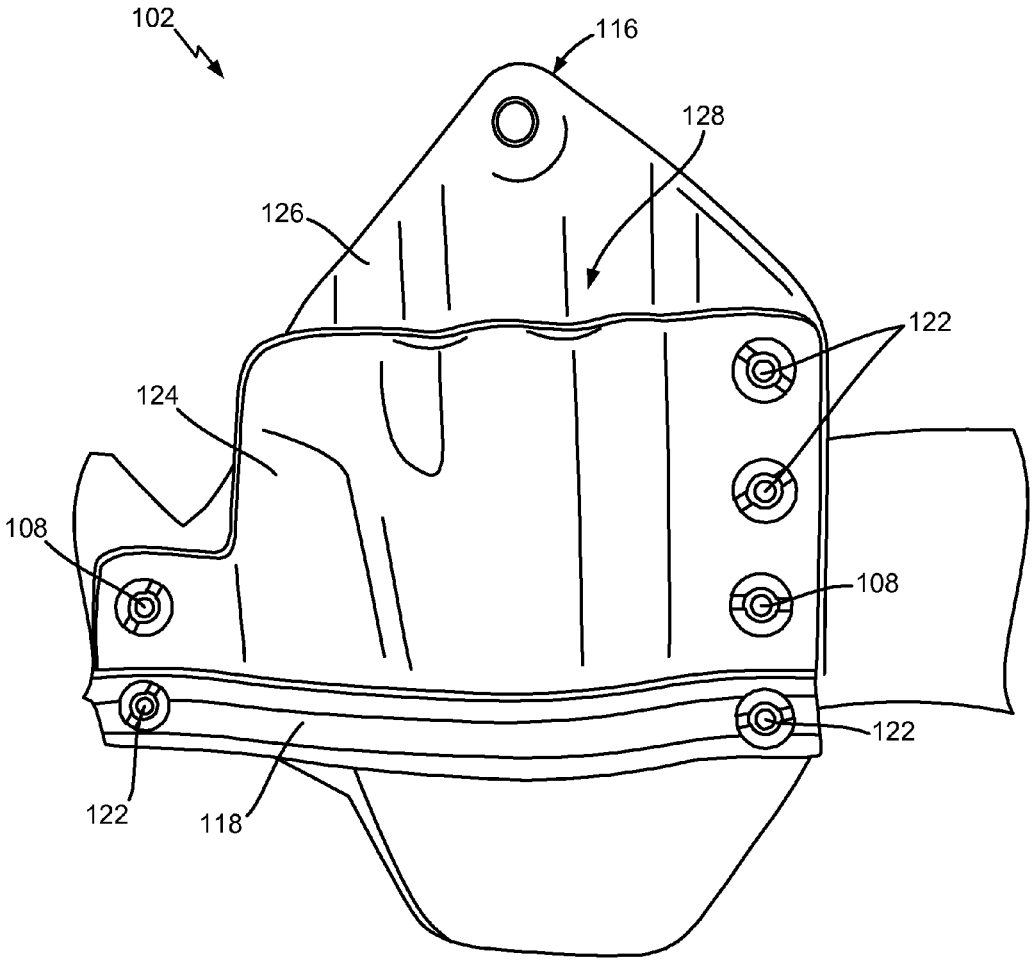
FIG. 3 is a schematic front view illustrating an implementation of a holster body of a deep concealment holster assembly.

According to an example implementation of FIG. 3, holster body 102 may comprise, for example, a front shell 124 and a back shell 126 interconnected via appropriate attachment means (e.g., attachment means 108, 122, etc.), such as to define a compartment 128 shaped for retainably securing an item, such as a handgun, as one example. Front shell 124 and/or back shell 126 may, for example, be made of substantially rigid material, such as a thermoplastic acrylic-polyvinyl chloride (PVC)-type composite, such as Kydex®, Boltaron®, etc., just to illustrate a few possible implementations. At times, compartment 128 for retainably securing an item may be shaped and/or sized for a particular item, such as a particular type, style, etc. of a handgun, for example, using one or more appropriate manufacturing techniques, such as thermomolding, thermoforming, injection molding, or the like. These or like techniques are generally known and need not be described here in greater detail. Optionally or alternatively, compartment 128 may comprise, for example, a so-called universal fit-type compartment, such as capable of accepting and/or retainably securing different types of items, such as different types of handguns, for example, with equal or like facility. Claimed subject matter is not limited to a particular material and manufacturing technique, of course. For example, in some instances, sufficiently stiff leather, ballistic nylon, etc. or any suitable combination of materials and/or manufacturing techniques may be used, in whole or in part, to implement a suitable compartment for retainably securing an item, such as compartment 128 for retainably securing a handgun, as one possible example.

In one particular implementation, an item may, for example, be retainably secured via a friction fit of such an item. For example, front shell 124 and back shell 126 may cooperate to exert tension on at least a portion of an item's surface to retainably secure the item within compartment 128, such as while the item is fully inserted into holster body 102. As was indicated, in some instances, a fully inserted item may comprise, for example, a handgun inserted to cover substantially a handgun barrel, a handgun trigger, and a handgun trigger guard, such as while leaving a handgrip of the handgun exposed for gripping, just to illustrate one possible implementation. Thus, by way of example but not limitation, at times, front shell 124 and back shell 126 may cooperate to exert tension on at least a portion of a handgun's slide, frame, and/or trigger guard, for example, so as to retainably secure the handgun within compartment 128 via friction. Here, exerted tension may comprise, for example, a substantially constant tension, such as irrespective of whether a holster assembly is worn in the intended manner, for example, which, at times, may be beneficial. For example, as discussed above, unlike hybrid or like holsters that may retain a holstered handgun due, at least in part, to tension created by an additional and/or supporting trouser belt, holster body 102 may exert or provide for a substantially constant tension irrespective of presence and/or tension of the trouser belt. This may facilitate or support more secure handgun retention, such as within compartment 128, for example, which may prevent a handgun from accidentally sliding off or falling out of holster assembly 102, as one example.

At times, cooperation of front shell 124 and back shell 126 may, for example, be facilitated or supported via attachment means 108 and/or 122, such as one or more adjustable tension or like screws capable of maintaining portions of front shell 124 and back shell 126 in a desired spaced relationship, just to illustrate one possible implementation. In some instances, a spaced relationship between portions of front shell 124 and back shell 126 may, for example, be defined by or correspond to, substantially or approximately, a width of an item to be retainably secured, or any suitable portion thereof, such as a width of a handgun's slide, frame, trigger guard, etc., as a few possible examples. Thus, at times, tension on at least a portion of a handgun's slide, frame, trigger guard, etc. may, for example, be changed and/or adjusted in a suitable manner, such as by tightening or loosening attachment means 108 and/or 122, such as one or more adjustable tension or like screws.

It should be noted that maintaining and/or adjusting a spaced relationship between portions of front shell 124 and back shell 126 may be optional in certain example implementations. For example, in some instances, attachment means 108 and/or 122 may comprise rivets or other non-adjustable fasteners, holster body 102 may comprise a one-piece, fold-over or wrap around holster body, spaced relationship may be pre-set at production, and so forth. It should also be appreciated that, at times, a suitable item (e.g., a handgun, etc.) may be retainably secured within compartment 128 defined by front shell 124 and back shell 126 other than by a friction fit of such an item. For example, in some instances, an appropriate lock, strap, lug, or other locking and/or retaining features or mechanisms may be employed herein, in whole or in part.

As was indicated and as further illustrated in FIG. 3, in an implementation, holster assembly 102 may comprise, for example, a thumb-pop element, referenced generally via an arrow at 116. As discussed below, thumb-pop element 116 may be used, at least in part, to facilitate one-handed withdrawal of an item (e.g., a handgun, etc.) from holster body 102, such as upon application of an external force. As such, thumb-pop element 116 may be made of substantially rigid material, such as material similar to front shell 124 and/or back shell 126, for example, and may be contiguous with holster body 102. In this context, "contiguous" should be interpreted broadly so as to include and/or encompass the terms like "part of," "disposed on," "proximate to," "in contact with," or like terms. In some instances, application of external force may comprise, for example, a pressure applied by a forward movement of a thumb of a wearer of a holster assembly so as to facilitate a linear sliding of an item, such as a handgun, for example, from holster body 102, as will be seen.

Accordingly, thumb-pop element 116 may, for example, be designed and/or positioned on holster body 102 so as to allow for thumb operation and/or application. For example, as seen, in at least one implementation, thumb-pop element 116 may be disposed on and/or comprise a portion of holster body 102. For example, thumb-pop element 116 may comprise a portion of back shell 126 curved outwardly near a wearer's thumb, such as while the wearer grips a handgun to withdraw it from a holster assembly in the intended manner. As also seen, at times, thumb-pop element 116 may be implemented, for example, with a riveted washer or like feature, such as for purposes of appearance, reinforcement, or the like. Claimed subject matter is not so limited, of course. As was indicated, holster body 102 may also feature strap 118, such as to reinforce holster body 102 or a portion thereof and/or generate additional friction between and/or resistance to motion of holster body 102 against an inner face of a user's lower garment, such as while worn in the intended manner and/or while withdrawing handgun 112, for example. At times, strap 118 may, for example, be made of substantially rigid material, such as material similar to front shell 124 and/or back shell 126, for example, and may be attached to holster body 102 via any suitable attachment means (e.g., attachment means 108, 122, etc.), just to illustrate a few possible implementations.

Figure 4:
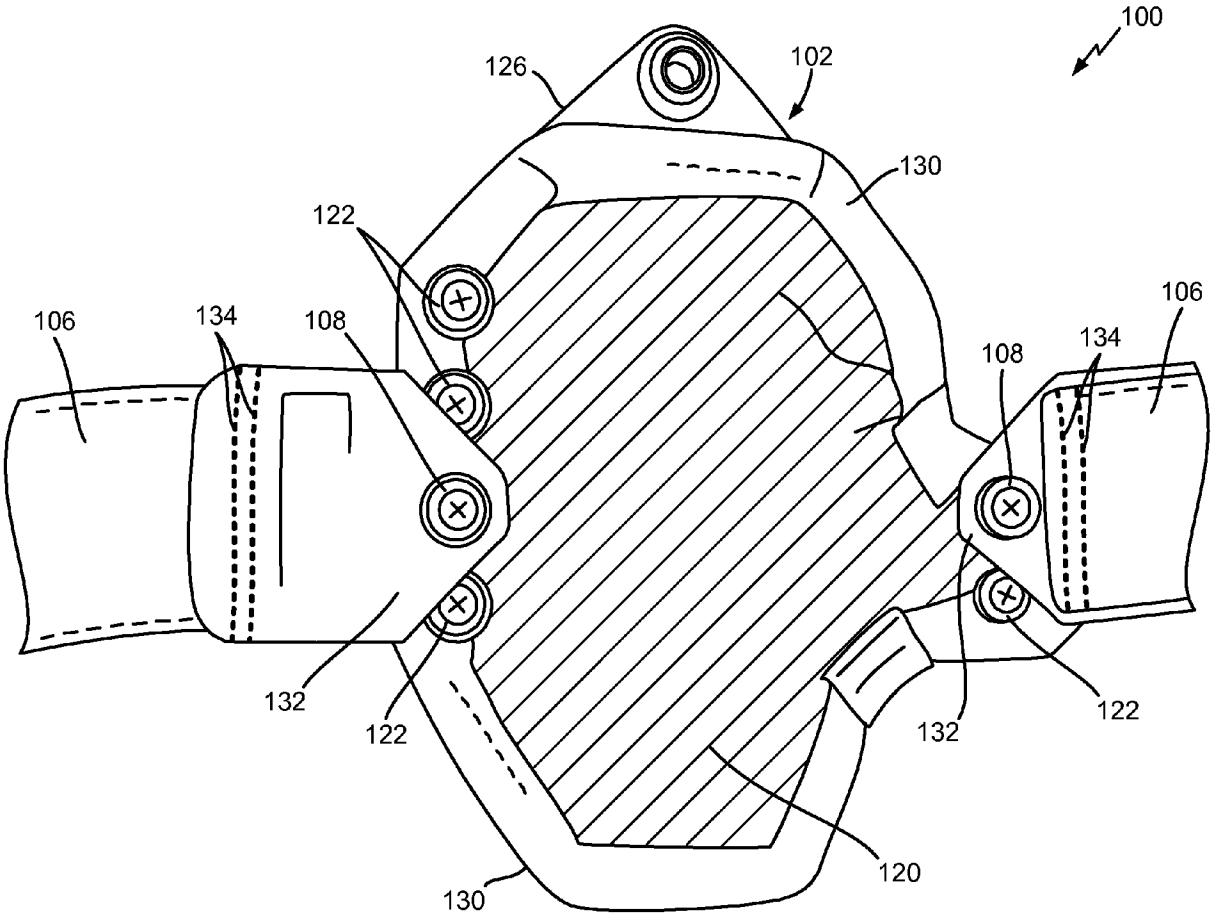
FIG. 4 is a schematic fragmentary back view illustrating an implementation of a deep concealment holster assembly.

As illustrated in FIG. 4, in an implementation, substantially flexible pad 120 of holster assembly 100 may comprise, for example, a generally flat panel that may be made, at least in part, of padded or non-padded fabric, plastic, leather, rubber, or the like, or any combination thereof. As was indicated, substantially flexible pad 120 may be attached to holster body 102 by one or more attachment means 122 and/or 108, such as to face a wearer while holster assembly 100 is worn in the intended manner. As such, at times, substantially flexible pad 120 may allow for more comfortable carrying (e.g., to address or alleviate skin irritability issues, etc.), prevent or limit holster assembly 100 from moving when worn against the skin and/or clothing, improve breathability, reduce bounce, or the like. As also seen, in at least one implementation, substantially flexible pad 120 may comprise, for example, a contoured edge 130 that may substantially match a contour of back shell 126 of holster body 102, or a portion thereof, such as to reduce a profile of holster assembly 100, as one possible example.

As also illustrated and as was previously mentioned, in an implementation, holster assembly 100 may comprise, for example, belt assembly 106, which is partially shown in FIG. 4 via its end portions (belt assembly is fully shown in FIGS. 1 and 2). Belt assembly 106 may, for example, be used, at least in part, for detachably attaching holster assembly 100 to a wearer. For example, in at least one implementation, belt assembly 106 may comprise, for example, a waist-encircling belt assembly, such as to secure it on a wearer's waist in a wrap-around fashion. Claimed subject matter is not so limited, of course. For example, at times, belt assembly 106 may be capable of being worn over the shoulder, around a leg, ankle, or the like, such as via adjusting and/or modifying belt assembly 106 without deviating from the scope and/or spirit of claimed subject matter. As seen, belt assembly 106 may comprise, for example, end segments 132 that may be secured to holster body 102 via attachment means 108. End segments 132 may, for example, be attached to inside and/or outside portion(s) of belt assembly 106 via any suitable means, such as one or more stitch lines 134, just to illustrate one possible implementation. It should be noted that, even though end segments 132 are illustrated herein as having a particular shape (e.g., triangular, etc.), end segments 132 may, for example, be implemented via any other suitable shape (e.g., rectangular, oval, circular, etc.).

As alluded to previously, belt portions connecting holsters to belts of known holster assemblies are typically made of a rigid, relatively inflexible material, such as plastic, stiff leather, metal, etc., so that the holster assemblies will remain fixedly positioned at all times. This may, however, make these or like assemblies less concealable and/or less comfortable to wear since, owing to the rigidity of a material, belts and/or connecting belt portions may not be able to bend and/or articulate so as to conform to the contours of a wearer's body. To address these or like issues, in an implementation, end segments 132 may, for example, be made of any substantially flexible material, such as, for example, polymer reinforced fabric, leather, rubber, etc., or any combination thereof, so as to allow holster body 102 of holster assembly 100 to articulate in more than one dimension, such as while holster assembly 100 is worn in the intended manner. For example, substantially flexible end segments 132 may allow holster body 102 to move and/or swivel in a plurality of dimensions so as to conform to some degree to an applicable portion of a wearer's body, such as a thigh, hip, torso, abdominal region, or the like. As was indicated, this may, for example, allow holster assembly 100 to be worn with unstructured clothing, such as without support of a waist belt, for example, without sacrificing holster's overall functionality and/or concealability. It should be noted that, for implementing end segments 132, a material resistant to abrasion, moisture, and/or stretching may be useful.

Figure 5:
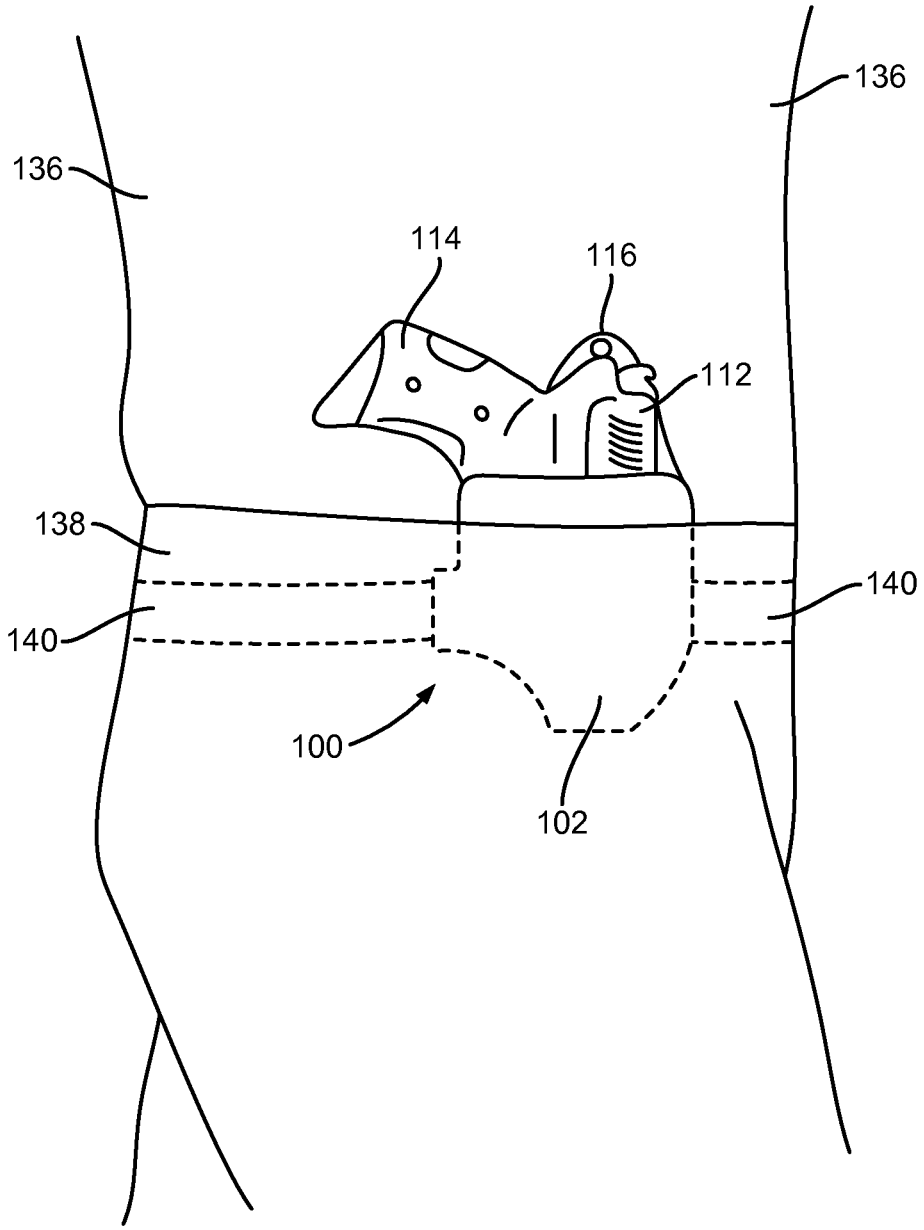
FIG. 5 is a schematic perspective view illustrating an implementation of a deep concealment holster assembly positioned on a wearer.

FIG. 5 is a schematic illustration of deep concealment holster assembly 100 being worn by a wearer 136, such as in the intended manner, for example, according to an implementation. As illustrated, here, holster assembly 100 may comprise, for example, a stand-alone unit capable of being worn about a torso or waist of wearer 136 with yoga-type pants, elastic waist khakis, or like unstructured clothing, indicated generally at 138, such as without a support of a waist or trouser belt. At times, a lower portion of holster assembly 100 may be tucked into pants 138, for example, as illustrated via dashed lines, and an upper portion of holster assembly 100 may be positioned above a pants' waist line, as illustrated via solid lines, but may be hidden or obscured underneath one or more layers of clothing (not shown), such as a jacket, shirt, t-shirt, etc., or any combination thereof. As seen, in some instances, belt assembly 100 may comprise, for example, a waist-encircling belt assembly, such as to secure belt assembly 100 on a wearer's waist in a wrap-around fashion via a waist-encircling belt 140.

Thus, in an implementation, such as while wearing holster assembly 100 in the intended manner, for example, wearer 136 may be capable of gripping, with one hand, grip 114 of handgun 112 releasably secured in holster body 102 of holster assembly 100, such as discussed above. For example, wearer 136 may be capable of placing a thumb of his or her hand on thumb-pop element 116 positioned on holster body 102 to be near the thumb upon gripping grip 114 of handgun 112, as was also indicated. As such, wearer 136 may be capable of pressing the thumb against thumb-pop element 116, such as while maintaining gripping of grip 114 with one hand, for example, and may be capable of withdrawing, while still maintaining gripping of grip 114 with one hand, handgun 112 from holster body 102, such as by pushing on thumb-pop element 116 with the thumb in a forward motion. This may, for example, allow handgun 112 to be pulled out from holster body 102 in a substantially linear sliding movement generally parallel to the orientation of a barrel of handgun 112, such as while holster assembly 100 remains substantially static, such as relative to the waist level of wearer 136.

Accordingly, as was indicated, a deep concealment holster assembly disclosed herein may provide benefits. For example, as a stand-alone unit, it may be capable of being worn with unstructured clothing, such as clothing that may be worn without support of a waist belt, as one example, while retaining or maximizing holster's tactical ability (e.g., one-handed withdrawal, re-holstering, etc.) without compromising concealability and/or everyday wearing comfort. Thus, a deep concealment holster assembly may better conform to an applicable portion and/or shape of a wearer's body, at-rest and/or in-motion, for example, may provide for more consistent retention of a handgun or other item(s) regardless of presence and/or tension of a trouser belt, may allow for one-handed withdrawal and/or re-holstering, may address or alleviate skin irritability issues, may provide for more consistent positioning and/or orientation of a firearm, or the like. Of course, such a description of certain aspects of a deep concealment holster assembly and its benefits is merely an example, and claimed subject matter is not so limited.

References throughout this specification to one implementation, an implementation, one embodiment, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or aspects described are capable of being combined in various ways in one or more implementations and, therefore, are within intended claim scope, for example. In general, of course, these and other issues vary with context. Therefore, particular context of description and/or usage provides helpful guidance regarding inferences to be drawn.

In the drawings and/or description, as was indicated, like parts and/or features are typically marked throughout the specification and/or drawings with the same reference numerals, respectively, if applicable. Again, the drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

While there has been illustrated and described what are presently considered to be example features and/or aspects, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter may also include all aspects falling within the scope of the appended claims, and equivalents thereof.

The terms, "and", "or", "and/or" and/or similar terms, as used herein, include a variety of meanings that also are expected to depend at least in part upon the particular context in which such terms are used. Typically, "or" if used to associate a list, such as A, B or C, is intended to mean A, B, and C, here used in the inclusive sense, as well as A, B or C, here used in the exclusive sense. In addition, the term "one or more" and/or similar terms is used to describe any feature, structure, and/or characteristic in the singular and/or is also used to describe a plurality and/or some other combination of features, structures and/or characteristics. Likewise, the term "based on" and/or similar terms are understood as not necessarily intending to convey an exclusive set of factors, but to allow for existence of additional factors not necessarily expressly described. Of course, for all of the foregoing, particular context of description and/or usage provides helpful guidance regarding inferences to be drawn. It should be noted that the following description merely provides one or more illustrative examples and claimed subject matter is not limited to these one or more examples; however, again, particular context of description and/or usage provides helpful guidance regarding inferences to be drawn.

What is claimed is:

1. A deep concealment holster assembly comprising:

a holster body comprising a front shell of substantially rigid material;

a back shell of substantially rigid material attached to the front shell by first attachment means to define a compartment shaped for retainably securing an item;

a substantially flexible pad comprising a generally flat panel attached by second attachment means to the holster body to face a wearer while the holster assembly is worn in the intended manner, wherein the substantially flexible pad is disposed over at least a portion of the back shell; and a belt assembly for detachably attaching the holster assembly to the wearer, the belt assembly comprising substantially flexible end segments secured to the holster body to allow the holster body to articulate in more than one dimension while the holster assembly is worn in the intended manner.

2. The holster assembly of claim 1, wherein the front shell and the back shell cooperate to exert tension on at least a portion of the item's surface to the retainably secure the item via friction while the item is fully inserted into the holster body.

3. The holster assembly of claim 2, wherein the item fully inserted into the holster body comprises a handgun inserted to cover substantially a handgun barrel, a handgun trigger, and a handgun trigger guard, while leaving a handgrip of the handgun exposed for gripping.

4. The holster assembly of claim 2, wherein the tension comprises a substantially constant tension irrespective of whether the holster assembly is worn in the intended manner.

5. The holster assembly of claim 2, wherein the tension is adjustable via use of the first attachment means or the second attachment means to maintain portions of the front shell and the back shell in a desired spaced relationship.

6. The holster assembly of claim 1, wherein the deep concealment holster assembly further comprises a thumb-pop element of substantially rigid material to facilitate one-handed withdrawal of the item from the holster body upon application of an external force.

7. The holster assembly of claim 6, wherein the application of the external force comprises a pressure applied by a forward movement of a thumb of the wearer to facilitate a linear sliding of the item from the holster body.

8. The holster assembly of claim 6, wherein the thumb-pop element is positioned on the holster body to allow for thumb operation.

9. The holster assembly of claim 6, wherein the thumb-pop element is contiguous with the holster body.

10. The holster assembly of claim 6, wherein the thumb-pop element comprises a portion of the holster body curved outwardly to be capable of being near the wearer's thumb while the wearer grips the item to withdraw the item from the holster body in the intended manner.

11. The holster assembly of claim 1, wherein the material used for the substantially flexible end segments allows the holster assembly to conform to the shape of a portion of the wearer's body to conceal the presence of the item.

12. The holster assembly of claim 1, wherein the first attachment means and the second attachment means comprise the same attachment means.

13. The holster assembly of claim 1, wherein the belt assembly comprises a waist-encircling belt assembly.

14. The holster assembly of claim 1, wherein the holster assembly comprises a stand-alone deep concealment holster assembly capable of being worn with unstructured clothing while concealing the holster assembly.

15. The holster assembly of claim 14, wherein the unstructured clothing comprises clothing capable of being worn without support of a waist belt.

16. The holster assembly of claim 1, wherein the substantially rigid material comprises a thermoplastic acrylic-polyvinyl chloride (PVC)-type composite.

17. The holster assembly of claim 16, wherein the thermoplastic PVC-type composite comprises at least one of the following: Kydex®; Boltaron®, or any combination thereof.

18. The holster assembly of claim 1, wherein the material used for the substantially flexible pad comprises at least one of the following: fabric; plastic; rubber; leather; or any combination thereof.

19. The holster assembly of claim 1, wherein the substantially flexible pad comprises a contoured edge that substantially matches a contour of the back shell of the holster body or a portion thereof.

20. A deep concealment holster assembly for receiving and for withdrawing a handgun with one hand of a user, the holster assembly to be worn substantially at waist level of the user and to remain substantially static at the waist level during the withdrawing at least partially via engagement of a user's thumb against a thumb-pop element, the holster assembly being joined together via adjustable fastener means and comprising:

a rigid holster comprising a united body with interior at least partially conforming to a shape of a particular handgun and capable of releasably retaining the handgun therein while substantially covering a handgun barrel, a handgun trigger, and a handgun trigger guard, the rigid holster further comprising the thumb-pop element positioned on the united body to be near the user's thumb while the user grips a grip of the handgun releasably retained in the rigid holster;

a substantially flexible liner positioned at a back side of the holster that is against the waist level while the holster assembly is worn in the intended manner, the flexible liner being sufficiently large to cover an area of the back side of the holster to a substantial degree and having an edge that approximately matches an outline of the back side thereby allowing for comfortably carrying the handgun and for increased friction between the holster and a user's body;

an adjustable waist-encircling belt for carrying the rigid holster and the substantially flexible liner, the belt having a pair of end portions of a substantially flexible material secured to at least the rigid holster, wherein the sections cooperate to conform to natural shapes of at least a portion of the rigid holster and at least a portion of the user's body thereby allowing the holster assembly to be worn with unstructured clothing while making the holster and the handgun releasably retained therein not readily visible.

* * * * *